US006364657B1

(12) United States Patent
O'Donnell

(10) Patent No.: US 6,364,657 B1
(45) Date of Patent: Apr. 2, 2002

(54) GAS BURNER

(75) Inventor: Michael J. O'Donnell, Rocky River, OH (US)

(73) Assignee: Beckett Gas, Inc., North Ridgeville, OH (US)

( * ) Notice: Subject to any disclaimer, the term of this patent is extended or adjusted under 35 U.S.C. 154(b) by 0 days.

(21) Appl. No.: 09/516,852

(22) Filed: Mar. 2, 2000

Related U.S. Application Data

(63) Continuation-in-part of application No. 09/213,838, filed on Dec. 17, 1998, now abandoned.

(51) Int. Cl.[7] ..... F23D 14/62
(52) U.S. Cl. ..... 431/354; 431/286; 431/350
(58) Field of Search ..... 431/354, 350, 431/349, 286, 351, 352; 126/39 R, 41 R, 39 E; 29/890.02, 890.039; 239/566

(56) References Cited

U.S. PATENT DOCUMENTS

| | | | | | |
|---|---|---|---|---|---|
| 3,002,552 | A | * | 10/1961 | Griffin | 431/154 |
| 3,092,168 | A | * | 6/1963 | Phlaum | 431/286 |
| 3,198,238 | A | * | 8/1965 | Hughes | 431/286 |
| 4,418,456 | A | | 12/1983 | Riehl | 431/354 |
| 5,176,512 | A | * | 1/1993 | Evens | 431/354 |
| 5,791,893 | A | * | 8/1998 | Charles, Sr. et al. | 431/328 |
| 5,873,713 | A | | 2/1999 | Osterhues | 431/354 |

FOREIGN PATENT DOCUMENTS

| | | | |
|---|---|---|---|
| DE | 2363611 | 12/1973 | 431/354 |
| FR | 1476874 | 3/1966 | 431/354 |
| GB | 1297005 | 11/1972 | 431/354 |
| JP | 56-66641 | 5/1981 | 431/354 |
| JP | 59-112110 | 6/1984 | 431/354 |

* cited by examiner

*Primary Examiner*—Ira S. Lazarus
*Assistant Examiner*—Josiah C. Cocks
(74) *Attorney, Agent, or Firm*—Watts, Hoffmann, Fisher & Heinke

(57) ABSTRACT

A gas burner is disclosed. The gas burner includes a burner body including a pair of adjoining metal stampings that form a serially connected gas supply passage, venturi region, and plenum chamber, the gas supply passage defining at least one air supply hole for introducing air into the gas supply passage. A burner port is defined by integrally formed recesses in each adjoining metal stamping, the burner port being in fluid communication with the plenum chamber and being oriented about 90 degrees with respect to the central axis of the burner. The gas burner is fabricated from a pair of adjoining sheet metal halves. An alternate gas burner includes a tapered burner port which provides a more uniform flame height because it compensates for velocity variations in the flowing air fuel mixture. A divider plate is also included in the port which improves flame stability.

2 Claims, 2 Drawing Sheets

114b
110
9
9
22'
12'
104
100
8
24'
101
30'
104
8
26a
26b 26b
26a
105
W1
102
W2
105

26b
26a
104
102a
120
30'
102
104
22'
102a 116
112
110
114a
24'
114a
112
116
110
101
114b
116
100

GAS BURNER

CROSS-REFERENCE TO RELATED APPLICATION

The present application is a continuation-in-part of U.S. patent application Ser. No. 09/213,838, filed Dec. 17, 1999 abandoned entitled "Gas Burner".

FIELD OF THE INVENTION

The present invention relates generally to gas burners, and more particularly to a stamped sheet metal gas burner and method of making the burner.

BACKGROUND ART

Gas-fired refrigerators, which may also be referred to as absorption-type refrigerators, require a gas burner or other source of heat for heating a generator containing an ammonia-water solution. The heat provided by the gas burner vaporizes ammonia from the solution which, in turn, flows to a rectifier. The rectifier separates the water from the ammonia and returns the water to the generator. The high-pressure ammonia vapor flows to the condenser where it condenses and then continues its path throughout the rest of the refrigeration circuit.

Portable gas-fired refrigerators, such as those designed for installation in recreational vehicles, require a gas burner with a relatively low output, typically less than 2000 Btu/hr., and a physical size that is compatible with other elements of the refrigerator, such as the generator, condenser, evaporator and absorber. This type of gas burner usually includes a gas input passage, an air supply hole and one or more burner ports. Air and gas are mixed in the body of the burner and then burned as the mixture is discharged from the burner port or ports. To maximize efficiency, the gas burner should provide clean combustion, a stable flame (for example not easily blown out by wind), and have a resistance to flash-back.

Flashback occurs when the flame from the burner burns backwards into the burner port. The flame may travel into the combustion chamber itself and eventually damage the burner. The conventional approach to inhibiting burner flashback is to make the burner ports with multiple holes or narrow slots. An increase in the depth of the burner port or slot will also reduce the potential for flashback. To achieve this, some prior art designs use thick cast iron from which an appropriately sized burner port is machined. The thick cast iron, however, may impede heat transfer from the material and is costly.

Burners made of thin materials, for example tubular or sheet metal burners, use a plurality of burner ports to achieve the required port area for the burner. The holes or slots are sized such that the flame is maintained within the cross-sectional area of the combustion chamber opening. However, as the size of the refrigerator increases and the corresponding output requirements of the burner increase, it becomes increasingly difficult to arrange the burner ports in a manner sufficient to fire into a relatively smaller area combustion chamber opening.

SUMMARY OF THE INVENTION

The present invention provides an improved gas burner and method of making the burner. The gas burner includes a burner body comprised of a pair of adjoining metal stampings. The metal stampings form an integral and serially connected gas supply passage, venturi region, and plenum chamber. The gas supply passage defines at least one air supply opening for introducing air into the gas supply passage. Each metal stamping includes an integrally formed recess such that when joined the stampings form a burner port in fluid communication with the plenum chamber. The burner port is oriented about 90 degrees with respect to the central axis of the burner.

In accordance with a preferred embodiment of the invention, the adjoining metal stampings are mirror images of each other. This facilitates cost-effective fabrication since the dies used to fabricate each metal stamping are likewise mirror images of each other. The stampings are joined together to form a seal at the joint of the stampings.

The present invention also provides a method of making the gas burner. A pair of sheet metal pieces are selected taking into consideration the final height and length of the burner as well as the desired length of the plenum chamber, venturi region, and gas supply passage. In the illustrated embodiment, air supply openings are provided in the sheet metal piece, most preferably at 180 degrees to each other. Each sheet metal piece is stamped on a die to form half sections of the gas burner. The stamped half sections are joined together using methods including, but not limited to, metal upsetting, mechanical closure, fusing or welding, to form a burner port and a serially connected gas supply passage, venturi region, and plenum chamber. A seal is formed between the adjoining stamped half sections.

According to the invention, the burner port is formed in a flange region of the burner by an offset portion formed in at least one of the burner halves. This construction results in a burner in which the burner port is raised above the combustion chamber, the spacing or distance between the burner port opening and the combustion chamber being determined by the height of the flanged region. The width of the flange in effect determines the "quenching depth" of the burner port. As is known, the greater the depth, the less chance of flashback. In addition, by providing a raised port opening, cooling of the overall burner is promoted since the flame itself is spaced from the combustion chamber and other portions of the burner.

According to another embodiment of the invention, the burner port is tapered in the direction of a longitudinal axis of the plenum chamber. In the illustrated embodiment, the width of the port nearest the inlet to the burner is narrower than the opposite end of the burner port. In the preferred embodiment, the width of the burner port increases uniformly from a minimum width to the maximum width. This tapering or decreasing width has been found to provide a more uniform flame height because it compensates for the variation in fuel mixture velocity that occurs in the burner.

According to another feature of this embodiment, a divider plate is disposed within the burner port and divides the port opening into two equal, symmetrical openings. In accordance with this feature, the burner halves are formed with transitions or formed sections which define a recess for the divider plate when the two halves of the burner are joined. In a more preferred embodiment, the ends of the plate have beveled ends which abut an abutment formed by the burner halves when they are joined which inhibits the divider plate from falling into the plenum chamber during assembly.

The alternative embodiment preferably includes a hexagonal-shaped insert having a centrally positioned threaded bore for receiving a gas orifice or other gas fitting. The burner halves are formed with hexagonal shaped portions which define a hexagonal recess adapted to receive the insert when the two burner halves are joined.

From the above it is seen that one object of the present invention is to provide a gas burner made of sheet metal and a method of making such a gas burner. This and other objects, advantages and features of the invention will be described in conjunction with a detailed description of a best mode for practicing the invention.

BEST MODE FOR PRACTICING THE INVENTION

Figure 1:
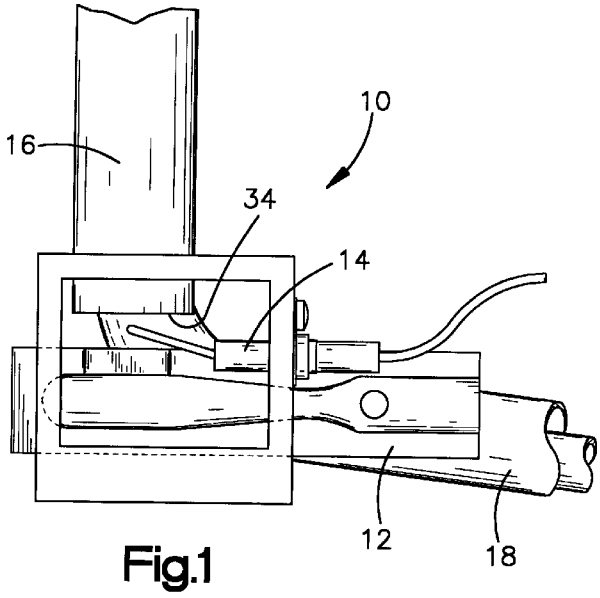
FIG. 1 is a front side view of a portion of a heat absorption refrigerator including a gas burner constructed in accordance with the present invention.
Figure 2:
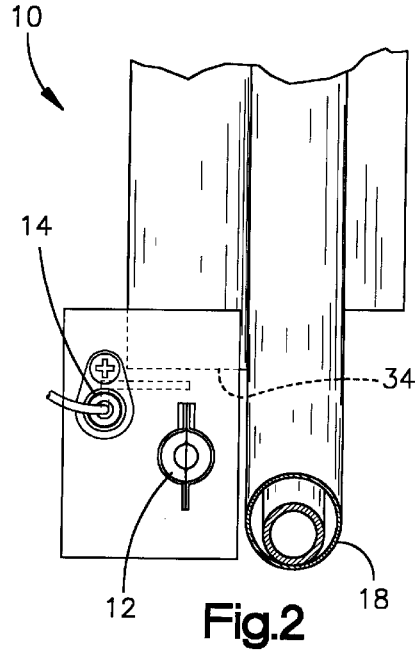
FIG. 2 is a right side view of the refrigerator shown in FIG. 1.

FIGS. 1 and 2 illustrate a heat source 10 of a absorption-type refrigerator that includes a gas burner 12, an ignitor 14, a combustion chamber 16 and a conduit portion 18 that forms part of an ammonia refrigerant circuit. The heat source 10 provides heat to the generator element of the ammonia refrigerant circuit. Other elements of the ammonia circuit include a condenser, an evaporator and an absorber (not shown). The conduit portion 18 of the heat source 10 conveys a refrigerant comprising an ammonia-water solution along the combustion chamber 16 where it is heated. Heat from the gas burner 12 is transferred to the conduit portion 18 from the adjacent combustion chamber 16 by conduction. The heat applied to the conduit 18 drives ammonia from the refrigerant in the form of a vapor. The ammonia vapor then flows to the condenser (not shown) where it is liquefied and continues throughout the remaining portion of the ammonia circuit.

While the gas burner 12 of the present invention is particularly applicable to heat absorption refrigerators, it should be understood that the burner 12 may be suitably adapted to other applications requiring a small inexpensive heat source.

Figure 3:
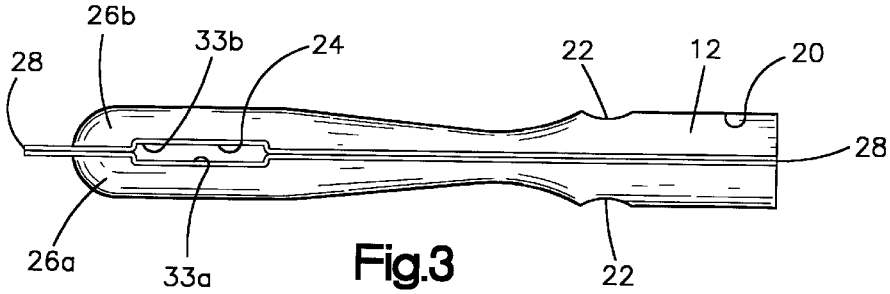
FIG. 3 is a plan view of the gas burner of the refrigerator shown in FIG. 1.
Figure 4:
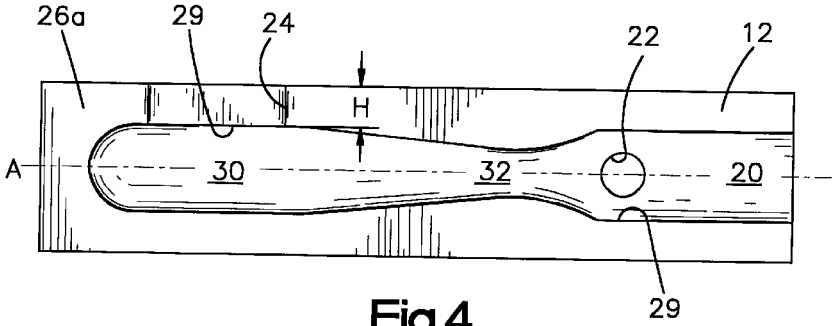
FIG. 4 is a front side view of the gas burner shown in FIG. 3.
Figure 5:
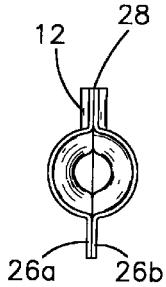
FIG. 5 is a right side view of the gas burner shown in FIG. 4.

Referring now to FIGS. 3 through 5, it is seen that the gas burner 12 includes an integrally formed gas supply passage 20, a pair of air supply openings 22 and a burner port 24. The burner port 24 is oriented 90 degrees with respect to the central axis A—A of burner 12. The burner 12 comprises a pair of adjoining sheet metal stampings 26*a*, 26*b*. The stampings 26*a*, 26*b* are joined together by known fastening methods including but not limited to, mechanical closure, metal upsetting, adhesive bonding, fusion or welding, to form a seam 28 that seals an interior region 29 of the burner 12. The interior region includes a serially connected plenum chamber 30, venturi region 32, and the gas supply passage 20.

As shown in FIG. 4, the height H of the flange material above the plenum chamber 30 formed by the adjoining stampings 26*a*, 26*b* determines the depth of the burner port 24. This provides a significant advantage over prior art devices in that the height of the flange material can be modified to produce the port 24 depth necessary to inhibit flashback for a given size burner port 24 by simply changing the height H of the flange material above the plenum chamber 30.

Another advantage of the present invention is that the seam material 28 acts as a heat transfer fin by transferring heat from the burner port 24 to the seam material 28. For this reason, it is believed that the burner 12 operates significantly cooler than conventional sheet metal burners. By keeping the burner 12 cool, the likelihood of flashback is substantially reduced and the life of the burner is substantially improved.

As shown in FIG. 3, the cross-sectional area of the burner port 24 is defined by recesses or offset portions 33*a*, 33*b* integrally formed in each stamped half 26*a*, 26*b* of the burner 12. Thus, the cross-sectional area of the burner port 24 can be modified by simply changing the depth of the offset portions 33*a*, 33*b* during stamping operation. This allows significant flexibility in selecting a suitable burner port cross-sectional area for a particular burner application.

Referring particularly to the heat absorption refrigerator shown in FIGS. 1 and 2, the cross-sectional area of the burner port 24 can be maximized to conform with the cross-sectional area defined by the combustion chamber opening 34. This provides a significant advantage over prior art designs in that the burner port 24 of the present invention can be adapted to a wide range of refrigerator requirements. For example, to increase the cooling capacity of the refrigerator there must be a corresponding increase in the amount of heat to be transferred to the ammonia circuit. According to the present invention, the cross-sectional area of the burner port 24 can be sized to the combustion chamber opening 34 so that the flame of the burner 24 is contained within the combustion chamber 16. This avoids the difficulty of some prior art designs wherein the quantity and arrangement of the burner ports are such that some of the burner flame extends outside the combustion chamber and reduces the overall efficiency of the system.

Referring now to FIG. 4, the venturi region 32 mixes the gas and air and causes a drop in the pressure of the air-gas mixture as it passes through the venturi region 32. The air-gas mixture then enters the plenum chamber 30. The plenum chamber 30 further mixes the air and gas and stabilizes the pressure before the air-gas mixture is discharged through the burner port 24. It is believed that the venturi region 32 and plenum chamber 34 promote cleaner combustion and a more stable flame than that exhibited by prior art burners.

The gas burner 12 is fabricated from two sheet metal halves 26*a*, 26*b*. In the preferred and illustrated embodiment and as shown in FIG. 3, the two halves 26*a*, 26*b* of the burner 12 are mirror images of each other. This facilitates cost-effective fabrication since the dies used to fabricate each sheet metal half 26*a*, 26*b* are also mirror images of each other. The first step is to size each sheet metal half 26*a*, 26*b* for the appropriate height and width. The height includes such factors as the desired diameter of the plenum chamber 30 and gas supply passage 20 as well as the desired depth of the burner port 24 or the height H of the flange material above the plenum chamber 30. The width includes such factors as the desired length of the plenum chamber 30, venturi region 32, and gas supply passage 20.

One or more air supply openings 22 are formed in each sheet metal half 26*a*, 26*b*. The openings may be punched or drilled. The sheet is then stamped on a die configured to form integral "half sections" of the plenum chamber 30, venturi region 32, gas supply passage 20 and the recessed portions 33a, 33b that form the burner port 24. The two sheet metal halves 26*a*, 26*b* are then joined together and form the seam 28.

It should be noted here that the present invention contemplates other constructions for the burner. For example, in the preferred embodiment, the burner comprises two stamped sheet metal sections with each section being the mirror image of the other. It is possible to construct a burner in which only one stamped section defines the integral plenum chamber, venturi region, gas supply passage and gas port. In this embodiment all the features of the burner would be formed in only one of the sheet metal halves. The other section could be formed by a flat metal plate or backplate. A burner is also contemplated in which some of the features are formed in one of the halves, whereas the remainder of the structures are formed in the other half.

If should also be noted that the "quenching depth" of the gas port 24 can be easily varied by changing the height "H" of the flanged region 28 of the burner. Those skilled in the art would recognize that, as the "H" dimension increases for a given burner size, the resistance to flashback increases. The raised gas port feature of this burner also promotes cooling of the overall burner increasing its useful life. The provision of a single burner port maximizes the burner port cross-section for a given combustion chamber size or cross-section.

Finally, the disclosed burner is shown as including air supply openings formed in the sheet metal halves. The invention contemplates a burner construction, that does not include the air openings as shown. A burner constructed in accordance with the principles of this invention can be constructed in which a separate gas orifice element is positioned at the inlet opening to the gas supply passage 20. Gas injected by the orifice into the passage 20 would draw combustion air into the passage 20 through openings or clearance space between the orifice and the supply passage. For this type of burner construction, the supply passage 20 shown in FIG. 4 would preferably have a shorter dimension and, in particular, would have an inlet opening that commenced near the region where the air openings 22 are shown in FIG. 4.

FIGS. 6–9 illustrate a burner 12' constructed in accordance with another embodiment of the invention. The burner 12' illustrated in these drawings is similar in function to the burner 12 shown in FIGS. 1–5. The burner 12' is fabricated from two sheet metal halves 26*a*', 26*b*' (see FIGS. 8 and 9). As in the first embodiment, the sheet metal halves 26*a*', 26*b*' are essentially mirror images of each other. The alternate burner 12' includes an integrally formed gas supply passage 20', a pair of oval shaped air supply or primary air openings 22' (only one is shown),a plenum chamber 30' and a burner port 24'.

Figures 6, 7, 8, 9:
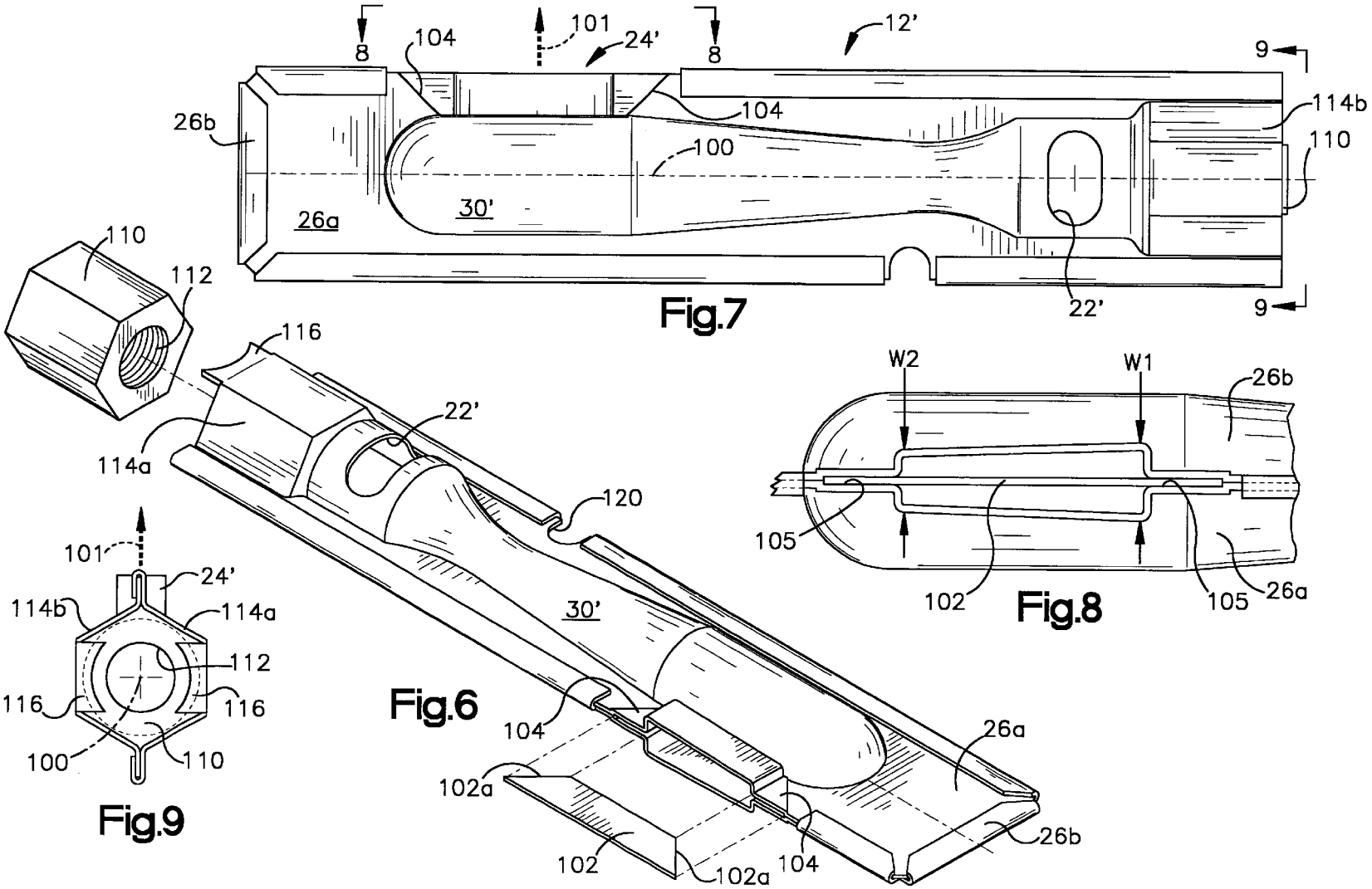
FIG. 6 is an exploded view of a burner constructed in accordance with an alternative embodiment of the invention.
FIG. 7 is a side elevational view of the burner shown in FIG. 6.
FIG. 8 is a fragmentary, top plan view of the burner shown in FIG. 7 as seen from the plane indicated by the line 8—8 in FIG. 7; and, FIG. 9 is an end view of the burner as seen from the plane indicated by the line 9—9 in FIG. 7.

In accordance with this embodiment, the port 24' (as seen best in FIG. 8) is tapered in the direction of a longitudinal axis or line 100 (see FIG. 7). In particular, and as best seen in FIG. 8, the port 24' has a width W1 that is greater than a width W2. In the illustrated construction the width of the port 24' decreases uniformly from width W1 to width W2. This tapering has been found to provide a more uniform flame height because it compensates for the variation in fuel mixture velocity caused by the change in flow direction imposed on the fuel mixture as it flows towards the port 24'. It has been found that a greater volume of the fuel air mixture is discharged at the left end of the port 24' (as viewed in FIG. 8), as compared to the right end of the burner. Referring to FIG. 7, it should be apparent that as the fuel mixture flows from the inlet side of the burner towards the port end of the plenum chamber, it must turn 90° to exit the port 24'. The change in direction is indicated in FIG. 9 by the axis or flow vector 100 and a flow vector 101 which depicts the flow direction of the fuel mixture out of the burner port 24'. This required change in direction causes a slight pressure increase in the fuel/air mixture that impinges the far end of the plenum chamber 30'. The portion of the port 24' (i.e., the portion of the port having a width W2 has a greater velocity than the fuel/air mixture traveling through the portion of the port closest to the inlet (i.e., where the width of the port is W1). By tapering the port as illustrated in the Figures, it uniformly restricts the volume of the fuel/air mixture that can be discharged, thus compensating for the velocity difference. With the tapered configuration, a more uniform flame height for the port 24' is achieved as compared to a port having a uniform width.

According to a feature of this embodiment, a port divider plate 102 divides the port 24' into two equal halves. The divider plate 102, as seen in FIG. 6, is staked in position during the stamping operation. In a more preferred embodiment, the ends 102*a* of the divider plate 102 are beveled and abut formed transitions or offset sections 104 formed in the burner halves 26*a*', 26*b*' during stamping of the individual halves. When the halves are joined, spaced apart recesses or pockets 105 for the divider plate 102 are defined. The plate 102 is inserted into the port after the burner halves 26*a*', 26*b*' are joined. The beveled transitions 104 prevent the divider plate 102 from falling into the plenum chamber 30' during assembly. The plate 102 is then locked in position by an auxiliary staking/stamping operation. The divider plate 102 improves flame stability during burner operation.

This embodiment also includes a hexagonal-shaped insert 110 which includes a centrally positioned threaded bore 112. The burner halves 26*a*', 26*b*' are formed with partial hexagonally-shaped recesses 114*a*, 114*b*. After assembly the partial recesses 114*a*, 114*b* together form an hexagonal recess adapted to receive the insert 110. After installation of the insert 110, locking tabs 116 are bent over the end of the insert 110 to maintain its position within the burner 12'. The threaded bore 112 of the insert 110 is adapted to receive an orifice element (nor shown) or other gas fitting.

The burner also includes a mounting notch 120 which facilitates mounting of the burner in the refrigeration apparatus.

Although the present invention has been described with a certain degree of particularity, it should be understood that those skilled in the art can make various changes to it without departing from the spirit or scope of the invention as hereinafter claimed.

What is claimed is:

1. A gas burner, comprising:

a) a burner body including a pair of adjoining metal stampings that form a serially connected gas supply passage, venturi region, and plenum chamber;

b) said gas supply passage defining at least one air supply opening for introducing air into said gas supply passage; and c) a burner port defined by offset portions integrally formed in each said adjoining metal stamping; said burner port being in fluid communication with said plenum chamber and being oriented about 90 degrees with respect to an axis of said plenum chamber, said burner port being tapered in a direction parallel to said axis of said plenum chamber.

2. A gas burner, comprising:

a) a burner body including a pair of adjoining metal stampings that form a serially connected gas supply passage, venturi region, and plenum chamber;

b) said gas supply passage defining at least one air supply opening for introducing air into said gas supply passage; and c) a burner port defined by offset portions integrally formed in each said adjoining metal stamping; said burner port being in fluid communication with said plenum chamber and being oriented about 90 degrees with respect to a central axis of said plenum chamber, said gas supply passage, venturi region, and plenum chamber being located along said central axis, said burner port being tapered in a direction parallel to said central axis of said plenum chamber.

* * * * *